US006016757A

United States Patent [19]

Boucherie

[11] Patent Number: 6,016,757

[45] Date of Patent: Jan. 25, 2000

[54] TUFTING DEVICE FOR A BRUSH TUFTING MACHINE

[75] Inventor: Bart Gerard Boucherie, Izegem, Belgium

[73] Assignee: G.B. Boucherie N.V., Belgium

[21] Appl. No.: 09/156,878

[22] Filed: Sep. 18, 1998

[30] Foreign Application Priority Data

Sep. 19, 1997 [DE] Germany ..... 297 16 874 U

[51] Int. Cl.[7] ..... D05C 7/00; A46D 3/04

[52] U.S. Cl. ..... 112/80.01; 300/5

[58] Field of Search ..... 112/6, 80.02, 78, 112/80.01, 80.04, 80.06, 284; 300/2, 4, 5, 8, 9; 227/79; 29/432.1

[56] References Cited

U.S. PATENT DOCUMENTS

| | | | |
|---|---|---|---|
| 1,936,743 | 11/1933 | Zahoransky . | |
| 2,084,345 | 6/1937 | Jobst | 300/8 |
| 2,243,495 | 5/1941 | Baumgartner | 300/4 |
| 2,901,289 | 8/1959 | Martin | 300/9 |
| 3,065,469 | 11/1962 | Parker | 300/8 X |
| 4,366,762 | 1/1983 | Willis | 112/80.06 |

FOREIGN PATENT DOCUMENTS

| | | |
|---|---|---|
| 70 11 423 | 3/1970 | Germany . |
| 18 14 868 | 7/1970 | Germany . |
| 43 24 249 A1 | 1/1995 | Germany . |

*Primary Examiner*—Ismael Izaguirre
*Attorney, Agent, or Firm*—Sixbey, Friedman, Leedom & Ferguson, PC; Stuart J. Friedman

[57] ABSTRACT

A tufting device for the filling tool of a brush tufting machine is provided which permits the operating stroke of the filling tool to be varied and adjusted without affecting operating speed and precision of operation. The tufting device has a guide block, a guide channel in the guide block, a tuft driver tongue driven with a reciprocating movement and movably received in the guide channel, and a header having a through channel aligned with the guide channel. The header and guide block are driven with a relative reciprocating movement towards and away from each other. The device further has a drive system with a rotating drive shaft, a cam on the drive shaft and a cam follower riding on the cam. The cam follower is driven by the cam with a reciprocating movement of a predetermined stroke length. The drive system further comprises a conversion mechanism for converting the reciprocating movement of a predetermined stroke length into a drive stroke of an adjustably variable length. The relative reciprocating movement of the header and guide block and the reciprocating movement of the tuft driver tongue are both derived from the drive stroke imparting a stroke of variable length to both reciprocating movements. The tuft driver tongue and the header and guide block consistently assume a predetermined initial position irrespective of the stroke length of the reciprocating movements for taking over a tuft of fiber.

10 Claims, 3 Drawing Sheets

TUFTING DEVICE FOR A BRUSH TUFTING MACHINE

FIELD OF THE INVENTION

The invention relates to a tufting device for brush tufting machine.

BACKGROUND OF THE INVENTION

As is well known in the art, the tufting or filling tool of a brush tufting machine comprises a guide block having a guide channel for a reciprocating tuft driver tongue and a reciprocating header in which the guide channel is continued. The tuft driver tongue pushes individual tufts of fiber or bristles with an anchor plate through the guide channel. Depending on the type of filling tool concerned the guide block may be either stationary or fixedly connected to the header or also movable relative thereto. In the latter case the guide block is configured as a separate pusher. The individual fiber tufts are picked by a tuft picker from a fiber box. The fiber tuft is inserted with an anchor plate or staple by the tuft driver tongue into the guide channel of the header which is fed to the surface of the brush body. When the header is located opposite to a tufting hole in the brush body the filling tool is driven into the tufting hole with anchor plate or staple. The drive for the filling tool is derived from a rotating drive shaft on which drive cams are seated non-rotatively. Running on the peripheral surface of these drive cams are cam followers from which the movement stroke of the tuft driver tongue and/or header and/or guide block is derived.

Filler tools of this kind work at a high speed or timing sequence, they being designed for a predetermined operating stroke of the header and the tuft driver tongue, as dictated by the brushes to be produced, more particularly by the length of the fibers or bristles. Although it has been proposed to control the operating stroke of the filling tool by electrical, pneumatic or hydraulic means, such systems proved to be much too slow and inaccurate.

SUMMARY OF THE INVENTION

The present invention provides a tufting device for the filling tool of a brush tufting machine, permitting the operating stroke of the filling tool to be varied and adjusted without affecting operating speed and precision of operation. In accordance with the invention, a tufting device is provided which has a guide block, a guide channel in the guide block, a tuft driver tongue driven with a reciprocating movement and movably received in the guide channel, and a header having a through channel aligned with the guide channel. The header and guide block are driven with a relative reciprocating movement towards and away from each other. The device further has a drive system with a rotating drive shaft, a cam on the drive shaft and a cam follower riding on the cam. The cam follower is driven by the cam with a reciprocating movement of a predetermined stroke length. The drive system further comprises a conversion mechanism for converting the reciprocating movement of a predetermined stroke length into a drive stroke of an adjustably variable length. The relative reciprocating movement of the header and guide block and the reciprocating movement of the tuft driver tongue are both derived from the drive stroke imparting a stroke of variable length to both reciprocating movements. The tuft driver tongue and the header and guide block consistently assume a predetermined initial position irrespective of the stroke length of the reciprocating movements for taking over a tuft of fiber.

The conversion mechanism is a purely mechanical system located directly in the force transmission path and introducing in the drive stroke an additional stroke only when required. Since the tuft driver tongue and the header always return to the same initial position relative to the guide block independent of the adjusted length of the drive stroke, tuft pickers, fiber boxes and the feed of anchor plate or staple remain unaffected by the variable drive stroke of the filling tool, i.e. necessitating only minor modifications to the conventional, generally accepted configuration of the filling tool.

Depending on the type of filling tool employed the guide block—as already indicated above—may be coupled either stationary or fixed to the header, as a result of which it is included in the movement thereof or relative to the header. In the latter case a conversion mechanism may be provided in a similar way between cam drive and guide block to enable the movement thereof to be varied mechanically, where necessary.

Various embodiments of the conversion mechanism inserted in the force transmission path are proposed.

In a first embodiment of the conversion mechanism a pivotably mounted lever is provided, at the one end of which the cam follower is arranged and the pivot mount of which has a variable spacing away from the cam follower. The magnitude of the movement stroke derived from the cam follower then depends on the length of the effective lever by which the drive of the filling tool is connected to the pivotably mounted lever. Since the pivot mount of the pivotably mounted lever is adjustable the reciprocating drive rod preferably coupled to the tuft driver tongue and/or header is connected to the lever at a fixed spacing away from the cam follower.

In accordance with a second embodiment of the conversion mechanism it comprises a reciprocating rod at one end of which the cam follower is arranged; furthermore the conversion mechanism includes a drive rod coupled to the tuft driver tongue and/or header and/or other parts of the filling tool (such as e.g. the guide block) and a linkage drivingly connecting mutually facing ends of the reciprocating rod and the drive rod. The linkage may consist of two links joined to each other articulatedly at one end and connected at the other end to the pusher and to the drive rod, respectively. The articulatedly interconnected ends of these links are constrained in an inclined plane, the inclination of which to the direction of movement of the pusher or drive rod is adjustably variable.

Common to both embodiments is that they permit a large variation of the operating stroke of the filling tool at little expense and by purely mechanical means located in the force flow path without affecting the operating speed and precision of operation of the filling tool.

BRIEF DESCRIPTION OF THE DRAWINGS

Further features and advantages of the invention read from the following description and from the drawing to which reference is made and in which.

DESCRIPTION OF PREFERRED EMBODIMENTS

Figure 1:
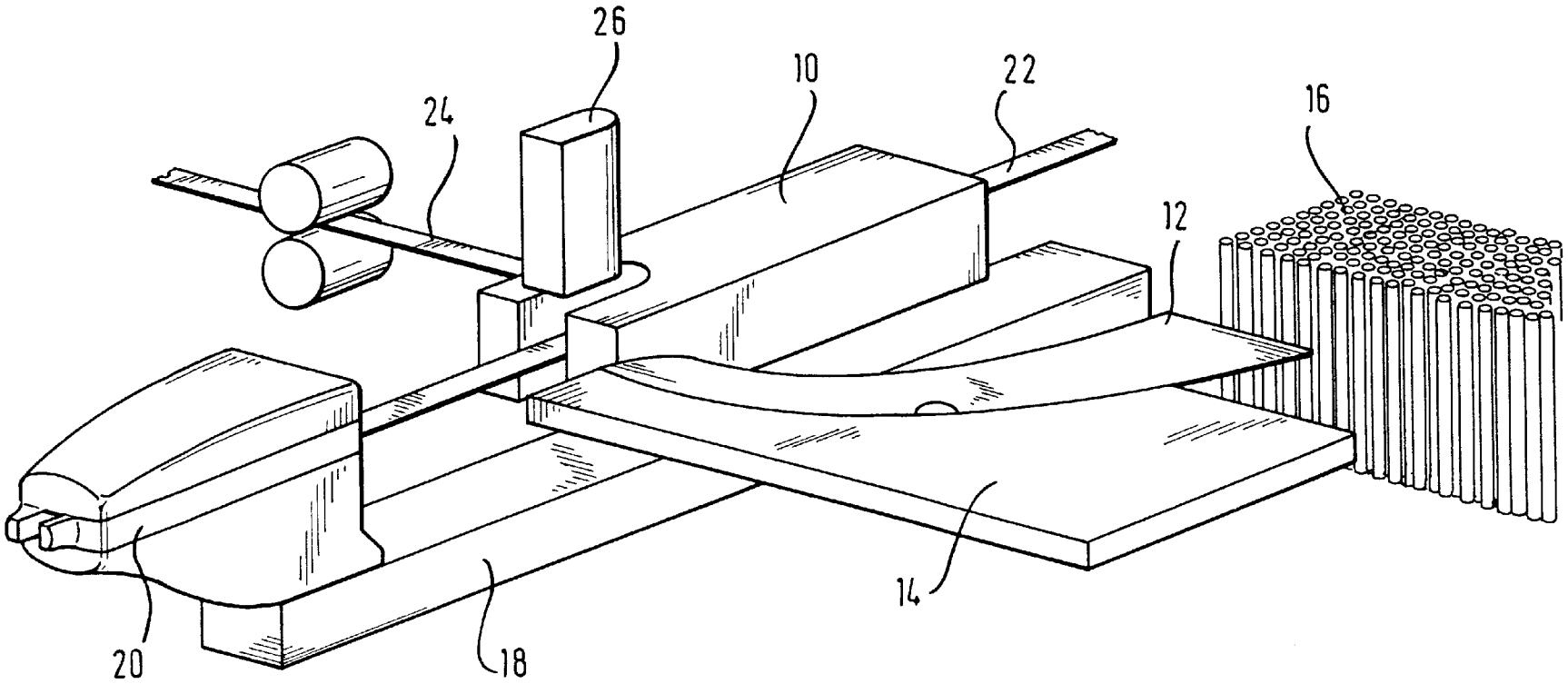
FIG. 1 is a schematic perspective view of a tufting tool.
Figure 2:
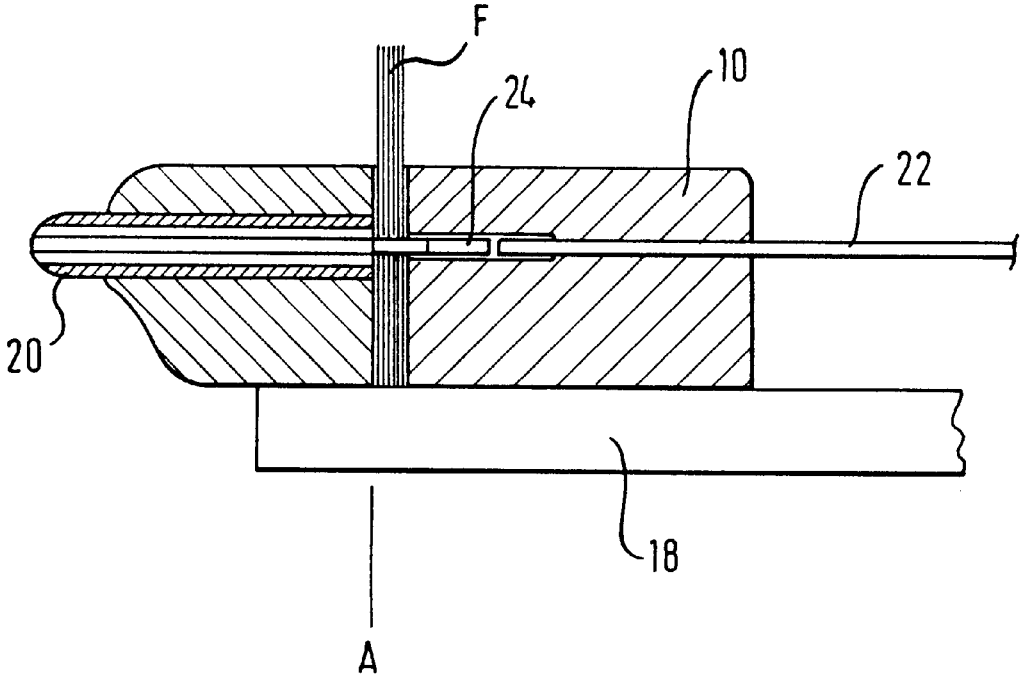
FIG. 2 is a longitudinal section through a header and a guide block of the filling tool.

Referring now to FIG. 1 there is illustrated a filling tool comprising in known ways and means, a guide block 10, a circular arc-shaped tuft picker 12 with a counterpiece 14 for picking the individual fiber tufts from a fiber box 16 and a header 20 secured to a pusher 18. Configured in the guide block 10 is a guide channel for a tuft driver tongue 22. This guide channel is continued in the header 20. The guide block is fed from one side a flat wire 24 from which single anchor plates are separated by a stamping tool 26. As an alternative, round wire is fed, from which staples are formed.

In the operation of such a filling tool, its header 20 is guided in a fast timing sequence to the individual tufting holes of the brush body and the tuft driver tongue 22 stuffs a tuft of fibers transferred by the tuft picker 12 into the guide channel of the header for each tufting hole in the brush body and stuffs it into the opposite tufting hole by an additional stroke.

It is obvious that the operating stroke of the header 20 and tuft driver tongue 22 needed for these functions of the filling tool depend on the length of the fibers or brushes, i.e. the type of brush to be bristled. This drive stroke cannot be varied on conventional filling tools.

In the tufting device of the invention a conversion mechanism is inserted in the force transmission path between filling tool and a rotating drive shaft, from which the drive movement is derived by means of cams and cam followers, the conversion mechanism enabling the drive stroke of the filling tool to be varied within broad limits without affecting the operating speed and precision of operation of the filling tool. The conversion mechanism also ensures that the rear initial position of the header and tuft driver tongue and, where provided, the guide block is always the same without influencing either the tuft picker, or the feed of the flat wire, from which the anchor plate is parted, or round wire, from which the staple is formed.

Figure 3:
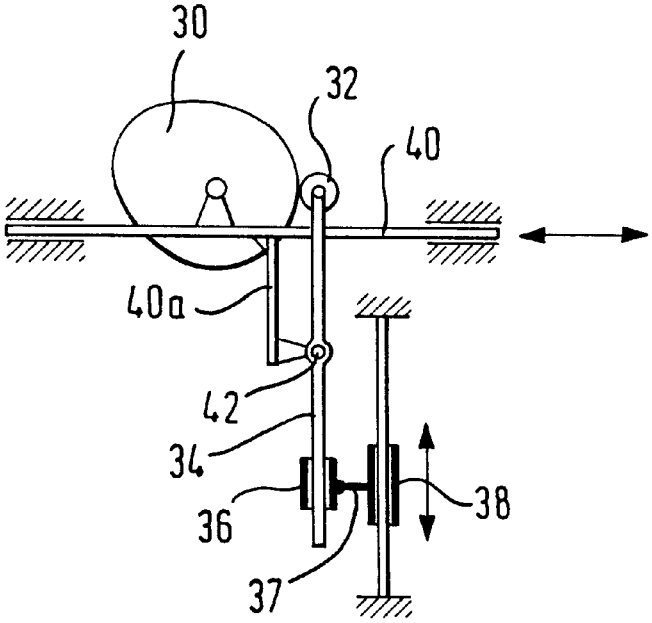
FIG. 3 is a schematic illustration of a conversion mechanism for varying the drive stroke of the filling tool.

Referring now to FIG. 3 there is illustrated schematically a first embodiment of this conversion mechanism. Non-rotatively mounted on a rotating drive shaft is a drive cam 30. Running on the peripheral surface of the cam 30 is a cam follower 32 arranged at one end of a lever 34, the other end of which is pivotably mounted in an adjustable pivot mount 36. By adjusting the pivot mount 36 via a conversion arm 37 coupled to the linear guide 38 the effective length of the lever 34 is varied. In the embodiment as shown, the pivot mount 36 is adjustable in the vertical direction. A horizontal reciprocating drive rod 40 to which e.g. the header 20 is connected, carries an arm 40*a* pivotably connected at 42 to the lever 34 at a fixed spacing away from the cam follower 32. In the rotary position of the cam 30 as shown in FIG. 3, corresponding to the initial position of the header 20, the lever 34 stands perpendicular to the guiding direction of the linear guide 38.

It will readily be appreciated that the magnitude of the operating stroke of the drive rod 40 derived from the cam follower 32 depends on the effective length of the lever 34, i.e. on the position of the pivot mount 36. The drive stroke of the drive rod 40 can thus be varied within broad limits.

In the embodiment as described above the drive stroke of the header 20 is varied. It will readily be appreciated that the drive stroke of the tuft driver tongue and/or guide block may be varied in similar ways and means by a similar mechanism. Thus, e.g. a plurality of drive cams 30 may be arranged on the drive shaft (e.g. 30' for the tuft driver tongue and 30" for the guide block) with a conversion mechanism associated with each cam to enable the stroke of each movement to be varied.

In another embodiment, which is not detained in the present, a similar conversion mechanism is used to shift the complete drive shaft including the cams 30, 30', 30", as a result of which the drive stroke of the header, tuft driver tongue and/or guide block is varied simulaneously by the same degree. The advantage of this aspect is that only one conversion mechanism is needed for simulaneously varying the stroke of different movements.

Figure 4A:
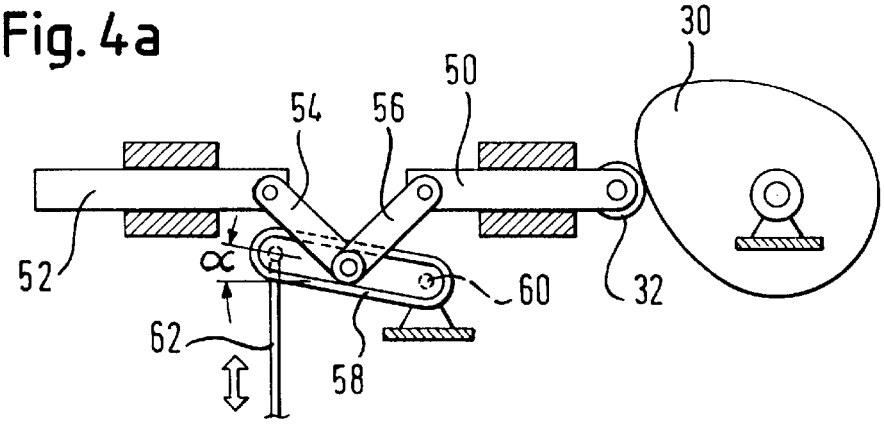
FIGS. 4*a* and 4*b* are schematic illustrations of a second embodiment of the conversion mechanism in various positions.
Figure 4B:
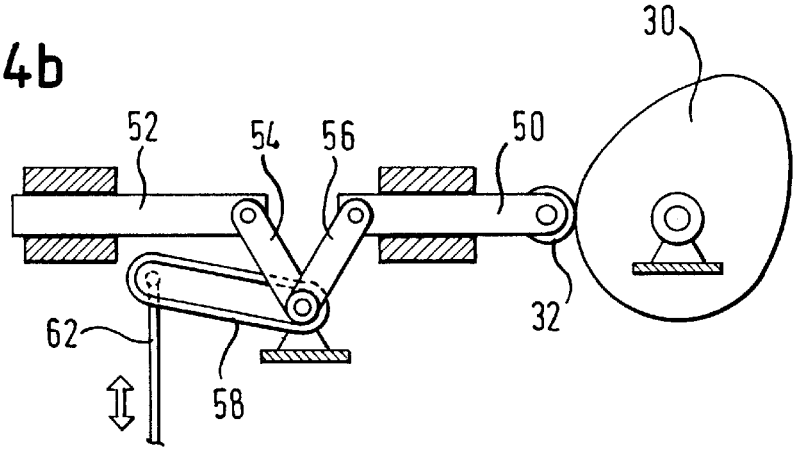
Figure 5:
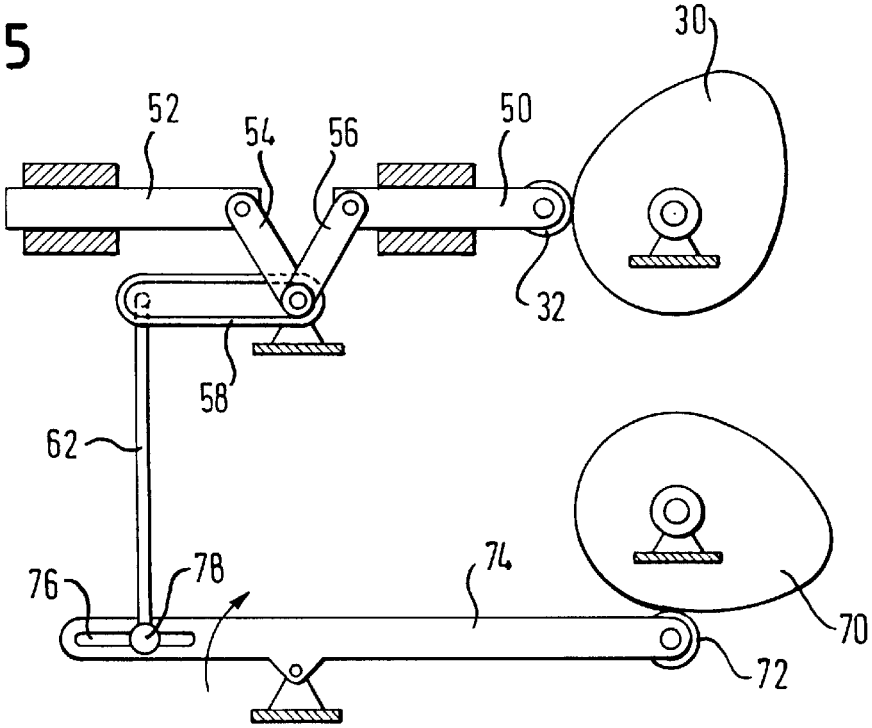
FIG. 5 illustrates a further aspect of this embodiment.

Referring now to FIGS. 4 and 5 there is illustrated an embodiment of the conversion mechanism in which the cam follower 32 is arranged at one end of a reciprocating rod 50 movably guided to shuttle horizontally, a drive rod 52 being likewise arranged shiftable in a horizontal reciprocating movement coaxial with and spaced away from this reciprocating rod 50. The facing ends of the reciprocating rod 50 and the drive rod 52 are drivingly coupled by two articulatedly connected links 54 and 56 which are articulatedly connected to each other by their adjacent ends. These ends of the links 54, 56 are constrained in a linear guide 58 pivotable mounted at 60 by its end adjacent to the reciprocating rod 50. Via the adjustment rod 62 the angle of inclination $\alpha$ of the guide linear guide 58 can be adjusted.

It will readily be appreciated that with this embodiment too, the drive Stroke derived from the cam 32, tranmitted by the links 54, 56 to the drive rod 52, may be varied via the angle of inclination $\alpha$ of the guide 58. The operating stroke of the filling tool connected to the drive rod 52 can thus be varied within broad limits. When the angle of inclination $\alpha$ is set to 0° the drive stroke is transmitted to the drive rod 52 without a change. In this embodiment too, the same initial position of the filling tool is assured after each operating stroke independent of the magnitude of the drive stroke.

Referring now to FIG. 5 there is illustrated an aspect of this embodiment in which adjusting the angle of inclination of the guide 58 is done via an additional control means. This control means comprises a shaft with a rotary cam 70 mounted thereon, and a cam follower 72 riding on the peripheral surface of the cam. A pivotably mounted two-armed lever 74 has one end on which the cam follower 72 is arranged, its other end being provided with a slot 76 in which an end designated 78 of the adjustment rod 62 engages. By rotating the cam 70 the drive stroke of the filling tool may be modulated in this aspect. An additional means of influencing this movement results from the slot 76 and the shifting of the end 78 of the adjustment rod 62 in said slot.

I claim:

1. A tufting device for a brush tufting machine, comprising a guide block, a guide channel in said guide block, a tuft driver tongue driven with a reciprocating movement and movably received in said guide channel, a header having a through channel aligned with said guide channel, said header and guide block being driven with a relative reciprocating movement towards and away from each other, and a drive system with a rotating drive shaft, a cam on said drive shaft and a cam follower riding on said cam;

said cam follower being driven by said cam with a reciprocating movement of a predetermined stroke length;

said drive system further comprising a conversion mechanism for converting said reciprocating movement of a predetermined stroke length into a drive stroke of adjustably variable length;

said relative reciprocating movement of said header and guide block and said reciprocating movement of said tuft driver tongue being both derived from said drive stroke imparting a stroke of variable length to both of said reciprocating movements;

said tuft driver tongue and said header and guide block consistently assuming a predetermined initial position irrespective of the stroke length of said reciprocating movements for taking over a tuft of fiber.

2. The tufting device as set forth in claim 1, wherein said conversion mechanism comprises a pivotably mounted lever, said lever having an end on which said cam follower is arranged, and said lever being mounted in a pivot bearing spaced an adjustably variable length from said cam follower.

3. The tufting device as set forth in claim 2, wherein a reciprocating drive rod has a first end coupled to at least one of said tuft driver tongue and header, and a second end connected to said lever a fixed spacing away from said cam follower.

4. The tufting device as set forth in claim 3, wherein said pivot mount of said lever is guided by a linear guide in a predetermined guiding direction and said lever in said initial position of said tuft driver tongue and said header being parallel to said guiding direction.

5. The tufting device as set forth in claim 1, wherein said conversion mechanism comprises a reciprocating rod having a first end on which said cam follower is arranged, a drive rod coupled to at least one of said tuft driver tongue and header, and a linkage drivingly connecting a second end of said reciprocating rod with said drive rod.

6. The tufting device as set forth in claim 5, wherein said linkage comprises a pair of coupling links a first one of which has a first end articulatedly connected to a first end of the other of said links an a second end articulatedly connected to said reciprocating rod, the other link having a second end connected to said drive rod.

7. The tufting device as set forth in claim 6, wherein said links have their first ends constricted in a plane which has an adjustably variable inclination to said reciprocating rod and to said drive rod.

8. The tufting device as set forth in claim 7, wherein said inclined plane is materialized by a linear guide which has a first end remote from said cam follower and a second end closer to said cam follower, said linear guide being pivotally mounted on said second end, and said first end being engaged by an adjustment member.

9. The tufting device as set forth in claim 8, wherein said adjustment member comprises an adjustment rod connected to a first arm of a pivotally mounted two-armed lever which has a cam follower on its second end, said cam follower riding on a rotary cam.

10. The tufting device as set forth in claim 9, wherein said two-armed lever comprises a slot wherein an end of said adjustment rod is shiftably engaged.

* * * * *